United States Patent [19]

Wyckoff et al.

[11] Patent Number: 4,821,358

[45] Date of Patent: Apr. 18, 1989

[54] GOLF CLUB WASHER

[75] Inventors: Charles R. Wyckoff, Fountain Hills; Ralph J. Lener, Scottsdale, both of Ariz.; William L. Samuelson, Minneapolis, Minn.

[73] Assignee: C.R.W. Manufacturing, Phoenix, Ariz.

[21] Appl. No.: 140,752

[22] Filed: Jan. 4, 1988

[51] Int. Cl.[4] ..... B08B 1/00

[52] U.S. Cl. ..... 15/104.92; 15/160; 15/21 B

[58] Field of Search ..... 15/104.92, 160, 21 B, 15/21 C, 21 R, 21 A, 164, 202, 210 A

[56] References Cited

U.S. PATENT DOCUMENTS

| | | | |
|---|---|---|---|
| 1,567,507 | 12/1925 | Howard | 15/176 |
| 3,221,355 | 12/1965 | Grommes | 15/160 |
| 3,224,029 | 12/1965 | Domingos | 15/104.92 |
| 3,400,416 | 9/1968 | Nicholson et al. | 15/21 A |
| 3,748,676 | 7/1973 | Warren et al. | 15/21 A |
| 4,380,839 | 4/1983 | Caradonna | 15/104.92 |
| 4,734,952 | 4/1988 | Parchment et al. | 15/104.92 |

*Primary Examiner*—Peter Feldman

*Attorney, Agent, or Firm*—LaValle D. Ptak

[57] ABSTRACT

A golf club head washing device, suitable for attachment to a golf cart or for mounting on posts at various locations on a golf course, includes a cylindrical housing for holding a cleaning fluid. The housing has guide rails located in it for supporting a pair of plastic brush blocks, with the brushes thereof facing one another across a diameter of the housing. A removable cover is releasably attached to the top of the housing; and the cover has an elongated slot in it, which is aligned with the space between the brush blocks. The brush blocks have tapered flanges on the opposing edges for engagement between guide rails on the inside of the housing to permit the blocks to be easily inserted and then wedged in place within the housing. When the brushes wear out, the blocks are removed by lifting them out of the housing. Then they are replaced with new blocks.

18 Claims, 2 Drawing Sheets

FIG. 1
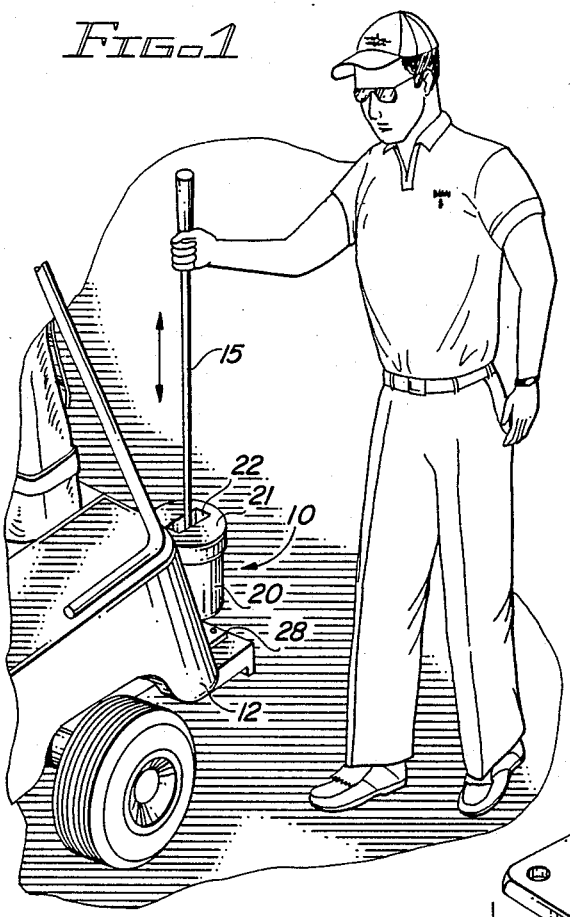
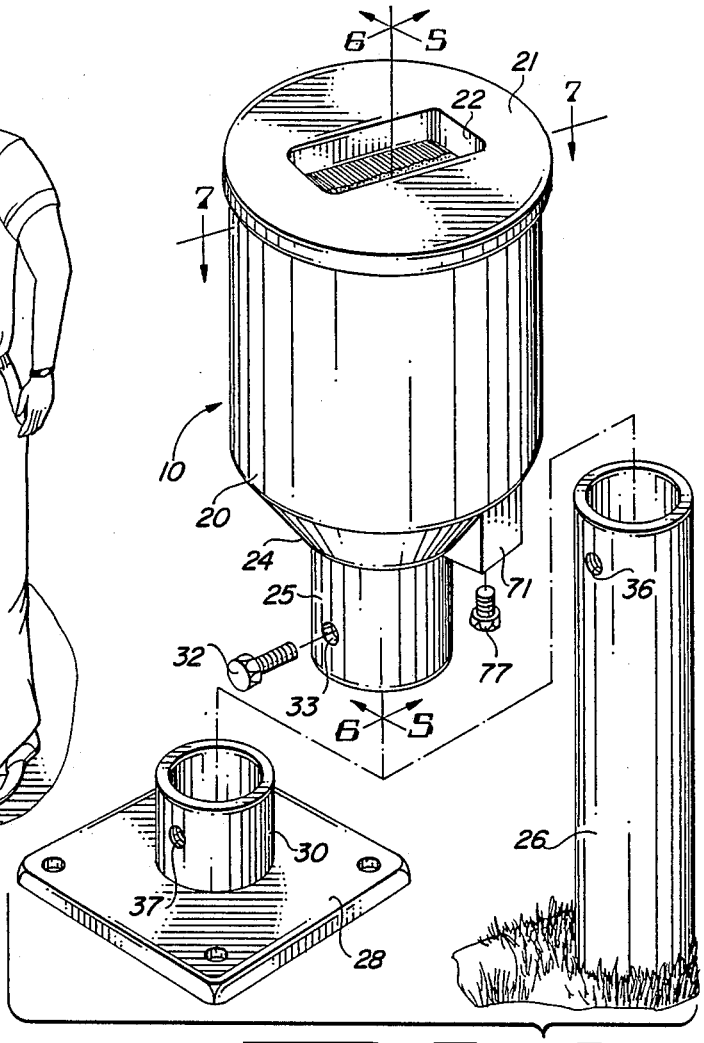
FIG. 2
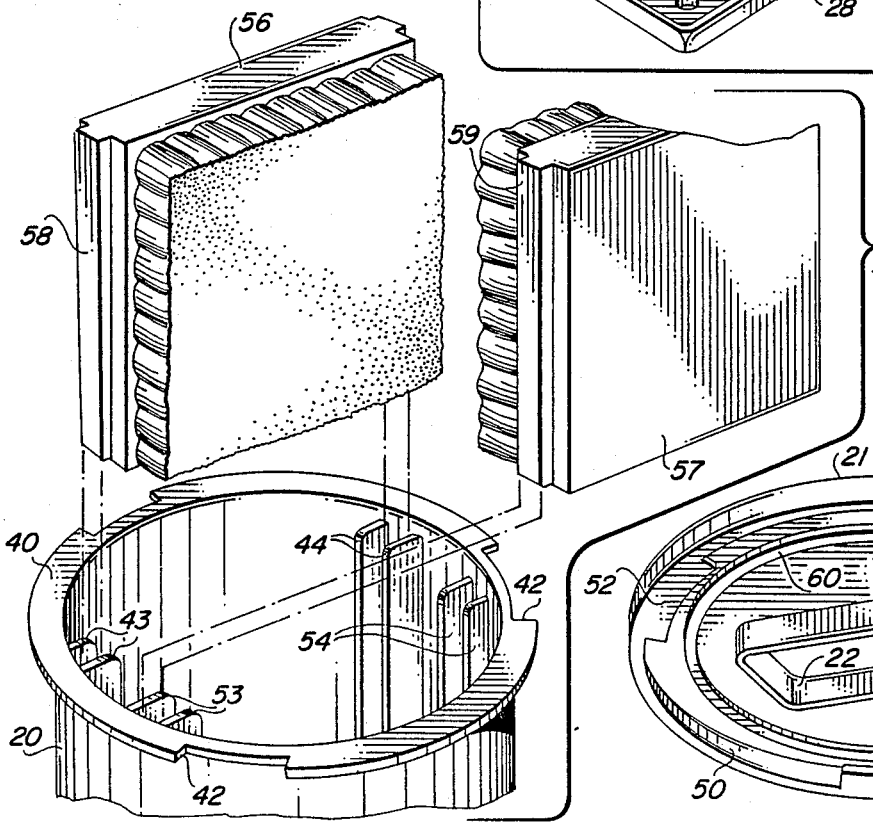
FIG. 3
FIG. 4
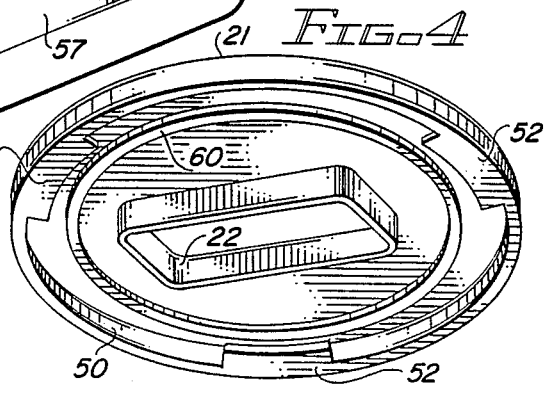

GOLF CLUB WASHER

BACKGROUND

When the game of golf is played, the golf club heads quickly become soiled through contact with dirt, mud, grass, and the like. The lines or grooves in the hitting surface of the head of the golf club are quickly and easily clogged with dirt or grass, which can have an undesirable effect when a ball is hit. In addition, some of the foreign matter which adheres to the various surfaces of the golf club head can cause corrosion or pitting of the head which further impairs its accuracy and appearance. Chemicals frequently are used for fertilizing the grass of a golf course, and some of these chemicals are highly corrosive, particularly when they are damp.

Golf club heads typically are cleaned at home or in the clubhouse using a bucket or sink full of water and a hand brush for scrubbing the golf club heads placed in the bucket or sink. This is a messy and time consuming process. It also is desirable to maintain the golf club heads clean during the playing of a game of golf. Consequently, golfers frequently carry cleaning rags or sponges for wiping off and cleaning the golf club heads after each use. While such frequent cleaning may be effected in this manner, it is necessary to carry around a damp sponge or rag in order to accomplish this purpose.

Efforts have been made to provide golf club cleaning devices or golf club washers which do not require a damp rag or a bucket of water and a hand held brush back at the clubhouse or at home.

Two patents which are directed to golf club head washing devices capable of location at various positions on a golf course, as well as at the clubhouse, are the Patents to Chambless U.S. Pat. No. 2,744,276 and Caradonna U.S. Pat. No. 4,380,839. The washer of Caradonna comprises a rectangular housing which is mounted on top of a post. The housing is partially filled with a cleaning solution, and two opposed brushes are held in place by a cover which has a pair of projections extending down to press against the top of the brushes to hold them in place against a seat built into the housing. Conventional wood block scrubbing brushes are used for the brush elements. The golf club head is cleaned by an up and down reciprocating motion after it is inserted through a slot in the cover to a position between the brushes. Since the brushes have a tendency to float upwardly when they are not held in place by the cover, replacement is somewhat difficult and messy, unless the liquid first is drained from the container.

The cleaner disclosed in the Chambless Patent is similar in some respects to the one of Caradonna, but Chambless has two different openings in it with two different brush sets for cleaning irons with one set and woods with the other. The brushes themselves are attached to a metal carrier rack which fits inside the container. Conventional wood block brushes are employed and they are each separately attached to the metal carrier by means of screws through their backs at various locations. When the brushes are worn out, the entire carrier rack and brush assembly is intended to be lifted out of the cleaner and replaced by a new carrier rack and set of brushes.

Three other patents directed to golf club head cleaning devices, which are more complex than the ones disclosed in the Chambless and Caradonna Patents, are the Patents to Postula U.S. Pat. No. 3,268,934; Hoag U.S. Pat. No. 3,872,534; and Hartz U.S. Pat. No. 4,069,536. The devices of Postula and Hoag both disclose rotary brush heads for cleaning the golf club. In Postula, a separate hand crank is provided, so that a person desiring to wash a club must hold the club with one hand and turn the crank with the other. In the device of Hoag, a separate electric motor is used to operate the cleaning brushes. Consequently, the Hoag device is not suitable for location at various places on a golf course, but is primarily suitable for use only at the club house.

The device of Hartz includes sponge like roll brushes mounted in the lid of a container, with the bottom portion of a rectangularly shaped box being lined with brush like material; so that the cleaning of a club is effected by reciprocal motion of the club between the cylindrical brushes in the lid and by turning it or reciprocating it against the surfaces within the bottom of the container. Replacement of the brushes is relatively time consuming, particularly for the brushes which are located within the liquid in the bottom portion of the container.

The Patent to Nicholson U.S. Pat. No. 3,400,416 discloses a somewhat different approach for washing the faces of a golf club. The golfer places the club in an opening in the top of the cleaning container. A separate handle then is grasped to move a reciprocating brush up and down across the face of the golf club head to clean it. A pair of opposing brushes also are located on opposite sides of a slot of the member moved by the reciprocating handle, so that golf balls also can be cleaned in the device.

It is desireable to provide a golf club head cleaning device which overcomes the disadvantages of the golf club head washers of the prior art, which is simple to use, simple and inexpensive to construct, and in which the cleaning elements easily and readily may be replaced.

SUMMARY OF THE INVENTION

Accordingly, it is an object of this invention to provide an improved golf club head washer.

It is another object of this invention to provide an improved golf club head washer which is easy to use and which may be installed in any desired location.

It is an additional object of this invention to provide an improved golf club head washer with replaceable stationary brushes used as the cleaning elements.

It is a further object of this invention to provide an improved golf club head washer which uses replaceable brush elements firmly held in place in the device during its operation, but which may be removed and replaced without tools.

In accordance with a preferred embodiment of the invention, a golf club head washing device includes a cylindrical housing for holding a cleaning fluid. The housing has an open top and tapers inwardly toward the bottom to facilitate the removal of dirty cleaning fluid from it. A pair of opposed cleaning members are supported within the housing on support guide rails attached to the interior of the housing and extending substantially parallel to the central axis thereof. The cleaning elements on the cleaning members extend substantially across the space between them. A removable cover is attached to the housing to close the open top, and the cover has an elongated slot located above the cleaning members and aligned with the space between them.

BRIEF DESCRIPTION OF THE DRAWINGS

FIG. 1 is a perspective view of a preferred embodiment of the invention showing its manner of use;

FIG. 2 is a partially exploded perspective view of a preferred embodiment of the invention;

FIG. 3 is a partially exploded view illustrating details of the embodiment of FIG. 2;

FIG. 4 is a perspective view of the underside of the cover of the embodiment shown in FIG. 2;

DETAILED DESCRIPTION

Figure 5:
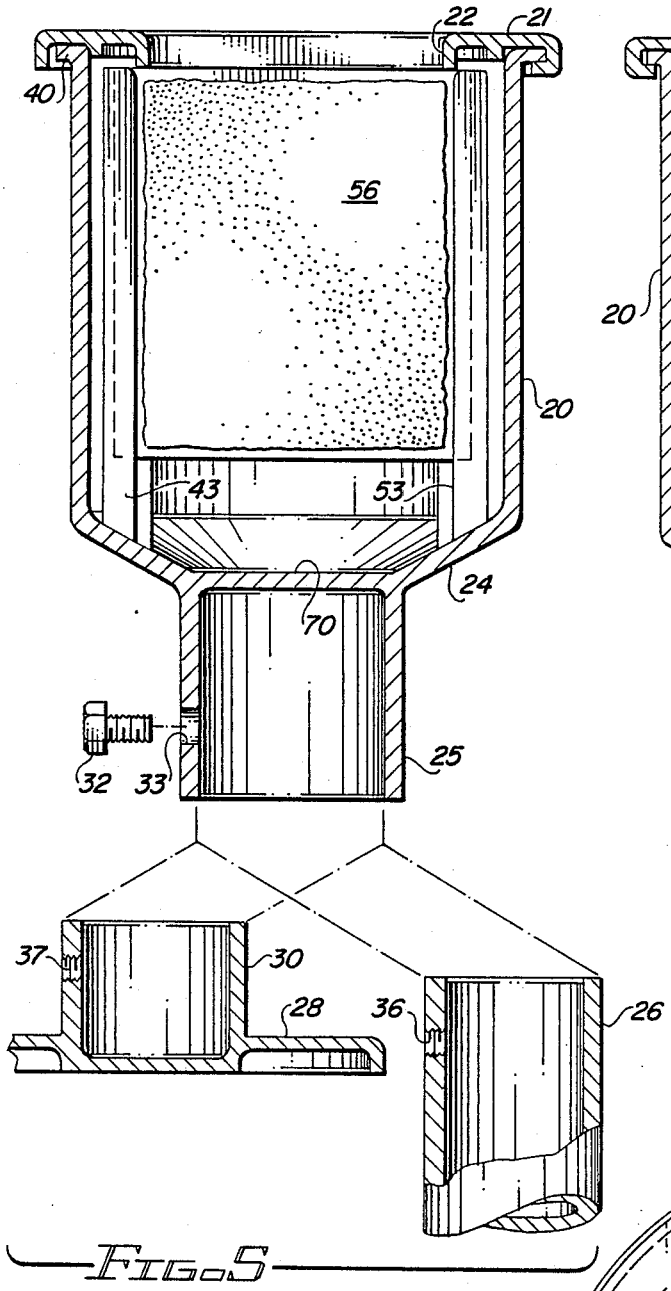
FIG. 5 is a cross-sectional view taken along the line 5—5 of FIG. 2.

Reference now should be made to the drawing in which the same reference numbers are used throughout the different figures to designate the same components. The golf club washing device 10 of a preferred embodiment of the invention includes a cylindrical outer housing 20 with an inwardly tapered portion 24 extending to the bottom 70 of the housing. A cylindrical connecting pipe 25 is attached to this bottom portion and is adapted to slip-fit over the top of a mounting post 26 (secured in the ground) or a mounting post 30 extending from a bracket 28. The bracket 28 may be attached to any suitable surface, such as the bumper of a golf cart 12 as illustrated in FIG. 1.

The container 20 is open at its upper end and is closed with a removable top 21 having a slot 22 located in the center of it. To use the device, a golfer places the head of a golf club through the slot 22 and reciprocates the shaft 15 of the golf club up and down, as illustrated in FIG. 1.

The cleaning, which is effected by the reciprocating motion of the golf club head in the device, is accomplished by means of a pair of oppossed rectangular brushes or brush blocks 56 and 57. These blocks are provided with outwardly extending flanges or tapered extensions 58 and 59 on the opposite sides thereof. The extensions 58 and 59 are tapered inwardly from the top toward the bottom and also are wider at the top than at the bottom. This facilitates the insertion of the brush blocks 56 and 57 into corresponding first and second sets of pairs of guide rails 43 and 44 (for the block 56) and 53 and 54 (for the block 57).

Figure 6:
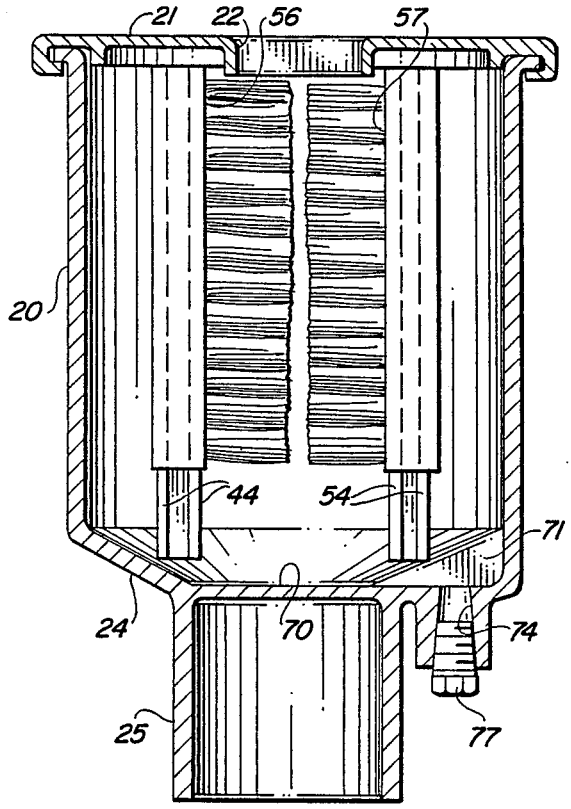
FIG. 6 is a cross-sectional view taken along the line 6—6 of the embodiment of FIG. 2.

The spacing between the guide rails of each of the sets 43, 44, 53, and 54, is substantially the same as the widest portion of the flanges 58 and 59 at the top. The inwardly tapered lower portions of the extensions 58 and 59 have sufficient clearance between the pairs of guide rails into which they are inserted to slide easily between the guide rail pairs, for example the pairs 43 and 44. When the blocks 56 and 57 are near their lowermost point of travel, the widened top portions of the flanges 58 and 59 and their increased width, cause the blocks 56 and 57 to be wedged securely between the pairs of guide rails 43, 44 and 53, 54. This causes the blocks 56 and 57 to be held firmly in place with the bristles facing one another as illustrated most clearly in FIGS. 3 and 6.

The blocks 56 and 57 preferably are made of suitable plastic material which does not interact with the water or cleaning soap placed in the container 20. The bristles of the brush blocks 56 and 59 preferably are of a similar material, such as nylon or other suitable plastic which is not weakened by continual immersion in the cleaning solution and which has long wear characteristics.

The container 20 is mounted either on the post 30 or a post 26 by slipping the lower cylinder 25 over the top of such a post. The cylinder 25 has a hole 33 in it which permits the free passage of a screw 32 through it. The posts 26 or 30 have corresponding threaded holes 36 and 37 through them, so that the threads of the screw 32 engage the threaded holes 36 or 37 to securely hold the cylinder 25 in place, over the end of the post 26 or over the post 30, forming a relatively permanent mounting for the container 20. In the event, however, that a container 20 should somehow become damaged, or replacement or removal is desired, it is a simple matter to remove the container 20 by unscrewing the screw 32 to permit separation of the cylinder 25 from either the post 30 or the post 26.

The inwardly tapered lower portion 24 of the container 20 serves to direct particles of debris and the dirty cleaning fluid to the bottom 70 of the container. A relatively narrow channel 71, the bottom of which is parallel with the base 70, is formed off to one side of the base 70. This channel has an opening 74 through it which is normally closed by means of a threaded plug 77. When it is desired to remove the cleaning fluid from the container 20, the plug 77 is removed to permit the fluid to drain out through the opening 74.

Figure 7:
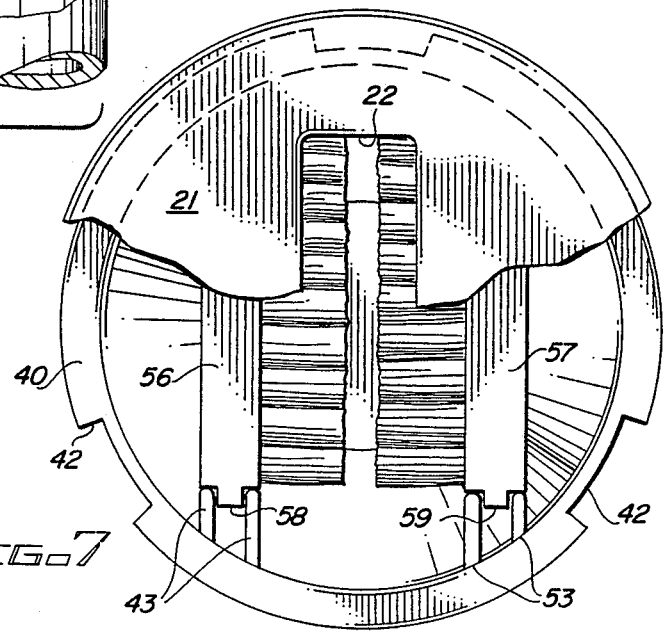
FIG. 7 is a partially cutaway top view of the embodiment shown in FIG. 2.

Once the brush blocks 56 and 57 are inserted in place between the respective pairs of guide channels 43, 44 and 53, 54, the top 21 is secured to the open upper end of the container 20. As shown most clearly in FIGS. 3 and 7, the upper end of the container 20 has an outwardly extending flange 40 on it. This flange has three equiangularly spaced slots 42 formed in it. The cover 21 has a downwardly depending skirt 50 on it; and this skirt has three inwardly extending tabs 52 on it which are slightly narrower in width than the width of the slots 42. To secure the cover 21 on the top of the container 20, the tabs 52 are placed over the slots 42 and the lid 21 is pressed downwardly. It then is twisted in a clockwise direction to align the rectangular slot 22 in the lid with a plane bisecting the container 20 along its axis. This bisecting plane also is parallel to both of the blocks 56 and 57 and is spaced an equal distance from the blocks; so that the bristles of the brush blocks 56 and 57 extend into the opening exposed by the slot 22.

When a golf club is to be cleaned, the head is inserted through the slot 22 and is engaged by the bristles of the blocks 56 and 57 on both sides. Up and down reciprocation of the club causes the bristles to engage the front, back, top and bottom surfaces of the head. The scrubbing action of the bristles, in conjunction with the cleaning fluid which fills one-half to two-thirds of the container, causes the head to be quickly and effectively cleaned.

Whenever the bristles of the brush blocks 56 and 57 become worn, or it is desired to replace the brush blocks for any reason, the blocks easily are removed by grasping them at the tops (which are above the fluid level) or by hooking them from underneath and lifting them upwardly. Since no fasteners of any type are used to hold the blocks in place, removal and replacement of the blocks 56 and 57 is a quick and simple operation.

A downwardly extending flange around the opening 22, as seen most clearly in FIG. 4, serves to hold the brush blocks 56 and 57 against upward travel when a golf club head is being cleaned, since the flange engages the upper row of bristles near the point where they are attached to the brush blocks 56 and 57. Thus, when the cover 21 is in place, the wedge like action of the flanges 58 and 59 on the brush blocks 56 and 57 prevent downward movement of the brush blocks beyond the point illustrated in FIGS. 5 and 6. Upward movement is restrained by the downward turned edge or flange of the opening 22 to securely hold the brush blocks 56 and 57 in place during use of the device, even though these blocks are easily removed after the cover 21 is taken off.

The foregoing description of the preferred embodiment of the invention should be considered as illustrative and not as limiting. Various changes and modifications will occur to those skilled in the art without departing from the true scope of the invention. For example, while a bayonet type of fastening of the cover 21 to the container 20 has been illustrated, other fastening techniques may be used for removably securing the cover 21 to the container 20. In addition, while pairs of spaced-apart guide rails are shown for securing an outwardly extending flange on the brush blocks, a single guide rail could be provided to mate with an elongated groove in the edge of the brush blocks 56 and 57 to accomplish the mounting of the brush blocks in a comparable manner to the manner shown in conjunction with the preferred embodiment. Various other changes and modifications will occur to those skilled in the art without departing from the true scope of the invention.

We claim:

1. A golf club head washing device including in combination:

a cylindrical housing for holding cleaning fluid, said housing having an open top and with the bottom thereof tapering inwardly toward a drain therein;

first and second rectangular cleaning members having cleaning elements extending from one surface thereof, each of said first and second cleaning members having first and second opposite edges with corresponding first and second extensions thereon;

cleaning member support guide rails attached to the interior of said housing and extending substantially parallel to the central axis thereof for releasably supporting and holding in place, through a wedging engagement of said extensions, said first and second cleaning members as an opposed pair of cleaning members, with the cleaning elements thereon extending substantially across the space between said cleaning members, said cleaning members being supported a predetermined distance above the bottom of said housing and releasably wedged and held in place by the engagement of said guide rails with said extensions on the opposite edges of said first and second cleaning members; and a removable cover releasably attached to said housing to close the open top thereof, said cover having an elongated slot therein located above the space between said cleaning members.

2. The combination according to claim 1, further including a downwardly depending flange extending around the elongated slot in said cover to guide the head of a golf club into the space between said cleaning members for engagement by the cleaning elements thereof.

3. The combination according to claim 2 further including drain means in the bottom of said housing for removing fluid therefrom.

4. The combination accordin to claim 3 further including a cylindrical post engaging extension attached to the outside of the bottom of said cylindrical housing for attachment to a suitable support post.

5. The combination according to claim 4 wherein the cleaning elements of said cleaning members comprise brush means.

6. The combination according to claim 5 wherein said first and second cleaning members comprise brush blocks made of plastic material with the cleaning elements comprising brush elements attached to the said one surfaces thereof when the brush blocks of said first and second cleaning elements are supported by said support guide rails in said cylindrical housing.

7. The combination according to claim 6 wherein said first and second extensions on the first and second opposite edges of said first and second cleaning members are tapered extensions for wedging engagement with said support guide rails for releasably holding said cleaning members in position said predetermined distance above the bottom of said cylindrical housing.

8. The combination according to claim 7 wherein said support guide rails include first and second pairs of spaced apart guide rails on opposite sides of the interior of said housing, with the spacing between the first and second pairs of guide rails on each side establishing the space between said cleaning members.

9. The combination according to claim 8 wherein said tapered extensions on the edges of said first and second cleaning members facilitate insertion thereof between the corresponding pairs of said support guide rails, with the widest portion of said tapered extensions located near the top of said cylindrical housing when said first and second cleaning members are wedged into place and supported therein by said guide rails.

10. The combination according to claim 9 wherein the top of said cylindrical housing has an outwardly extending lip with slots therein, and said cover has a corresponding inwardly extending set of projections spaced about the circumference thereof to mate with the slots in the lip of said housing for forming a bayonet fastener for releasably attaching said cover to said housing.

11. The combination according to claim 1 wherein the cleaning elements of said cleaning members brush means.

12. The combination according to claim 1 wherein said first and second extensions on the first and second opposite edges of said first and second cleaning members are tapered extensions for wedging engagement with said support guide rails for releasably holding said cleaning members in position said predetermined distance above the bottom of said cylindrical housing.

13. The combination according to claim 12 wherein said support guide rails include first and second pairs of spaced apart guide rails on opposite sides of the interior of said housing, with the spacing between the first and second pairs of guide rails on each side establishing the space between said cleaning members.

14. The combination according to claim 13 wherein said tapered extensions on the edges of said first and second cleaning members facilitate insertion thereof between the corresponding pairs of said support guide rails, with the widest portion of said tapered extensions located near the top of said cylindrical housing when said first and second cleaning members are wedged into place and supported therein by said guide rails.

15. The combination according to claim 14 wherein said first and second cleaning members comprise brush blocks made of plastic material with the cleaning elements comprising brush elements attached to the said one surfaces thereof when the brush blocks of said first and second cleaning elements are supported by said support guide rails in said cylindrical housing.

16. The combination accordin to claim 1 further including a cylindrical post engaging extension attached to the outside of the bottom of said cylindrical housing for attachment to a suitable support post.

17. The combination according to claim 1 wherein the top of said cylindrical housing has an outwardly extending lip with slots therein, and said cover has a corresponding inwardly extending set of projections spaced about the circumference thereof to mate with the slots in the lip of said housing for forming a bayonet fastener for releasably attaching said cover to said housing.

18. The combination according to claim 1 wherein said first and second cleaning members comprise brush blocks made of plastic material with the cleaning elements comprising brush elements attached to the said one surfaces thereof when the brush blocks of said first and second cleaning elements are supported by said support guide rails in said cylindrical housing.

* * * * *